US005348198A

United States Patent [19]

Mizzi et al.

[11] Patent Number: 5,348,198

[45] Date of Patent: Sep. 20, 1994

[54] REFILLABLE AEROSOL CONTAINER

[75] Inventors: John V. Mizzi; Donald A. Merte, both of Poughkeepsie, N.Y.

[73] Assignee: Omnific International Ltd., Poughkeepsie, N.Y.

[21] Appl. No.: 934,781

[22] Filed: Aug. 24, 1992

[51] Int. Cl.[5] ..... B05B 9/00

[52] U.S. Cl. ..... 222/401; 222/209; 239/373; 239/363; 239/360

[58] Field of Search ..... 222/209, 401, 402.1; 239/337, 355, 357, 360, 363, 373

[56] References Cited

U.S. PATENT DOCUMENTS

| | | | |
|---|---|---|---|
| Re. 33,564 | 4/1991 | Ford, Jr. | 222/209 |
| 3,955,720 | 5/1976 | Malone | 222/401 X |
| 3,995,779 | 12/1976 | Mizzi | 222/401 |
| 4,147,284 | 4/1979 | Mizzi | 222/401 |
| 4,492,320 | 1/1985 | Tada | 222/401 X |
| 5,192,009 | 3/1993 | Hildebrandt et al. | 222/401 X |
| 5,267,674 | 12/1993 | von Schuckman | 239/360 X |
| 5,285,966 | 2/1994 | Czech | 239/373 X |

*Primary Examiner*—Andres Kashnikow
*Assistant Examiner*—Anthoula Pomrening
*Attorney, Agent, or Firm*—Alfred M. Walker

[57] ABSTRACT

A device for the spraying of liquids includes an air compressor or pump driven by a weight activated by shaking the device in an essentially vertical direction. The device consists of a resuable liquid module containing a liquid to be sprayed; a pump module attached to a screw cap for the liquid module and contained within the liquid module; a compressed air duct connecting the outlet of the air pump to the liquid module and a fluid conduit conducting the fluid to be sprayed from the liquid module to the outlet valve for discharge under the influence of the compressed air.

13 Claims, 5 Drawing Sheets

FIG. 3
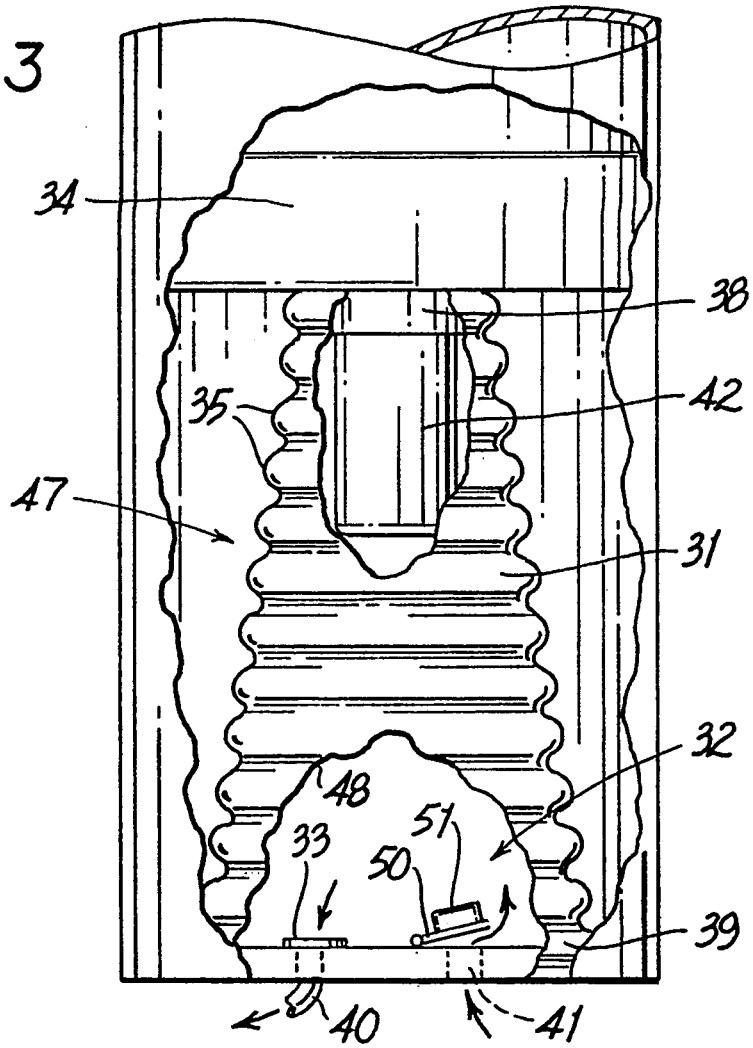
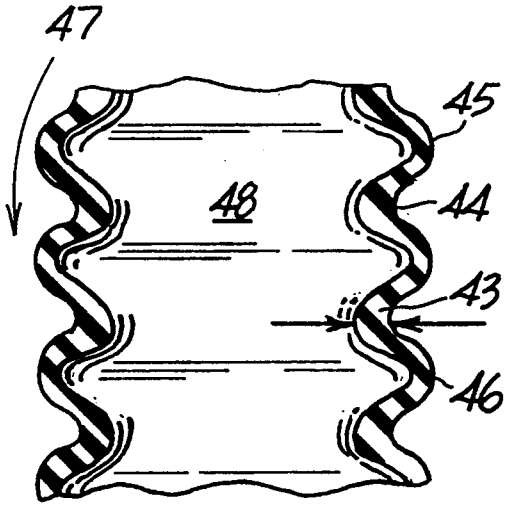
FIG. 3A
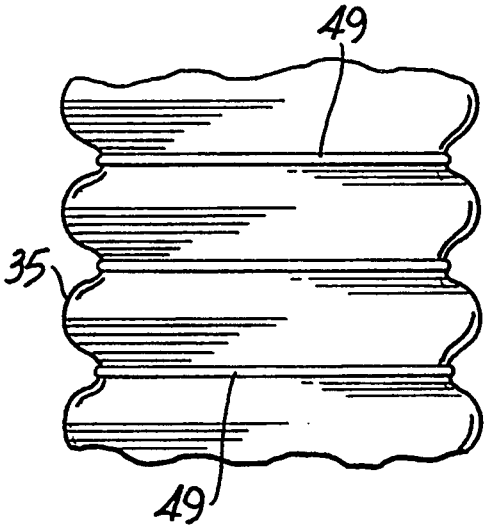
FIG. 3B

REFILLABLE AEROSOL CONTAINER

BACKGROUND OF THE INVENTION

The present invention relates to an aerosol dispenser which uses compressed air as the propellant. The adoption of this dispenser as a substitute for ordinary household aerosols eliminates the use of chemical propellants such as chlorofluorocarbons or hydrocarbons. The non-disposable refillable dispenser uses air as the propellant. This is generated by the natural act of shaking the dispenser a few times before using which compresses air via a small Dump located inside the unit.

DESCRIPTION OF THE PRIOR ART

The prior art includes U.S Pat. Nos. 3,995,779 and 4,147,284 of the Applicant. These patents pertain to the use of compressed air to urge a liquid spray from a dispenser, instead of conventionally using a chemical propellant, which may be harmful to the environment.

SUMMARY OF THE INVENTION

The present invention improves the prior art with the following novel features. A refillable dispenser is provided wherein a compressor assembly is attached to a screw-on cap, thereby permitting the use of standard blow molded or metallic even glass containers. The volume within the compressor housing is vented through the cap but is isolated from the pressurized container.

A further improvement is provided in the use of tapered bellows as an air pumping compressor element.

Generally, the present invention includes a liquid module containing a liquid to be sprayed, and a pump module with an air compressor pumping means, with the liquid spray flowing in response to urging by the compressed air.

The liquid module has a screw cap disposed to the pumping module, such that the pumping module is located within the confines of the liquid module.

Using a piston & cylinder type of compressor is a workable solution. However, sizing the stroke, bore and driving weight is a compromise which stacks a desire for quick pressure build-up of an unpressurized depleted container against a desire for high maximum pressure with a given weight and oscillatory frequency. A bellows would pose a similar compromise.

The piston and cylinder pumping module may be further modified with a telescoping piston and cylinder assembly as shown in FIG. 4. In addition to a housing 13, 1 driving weight 12, and inlet and outlet check valves 28 and 29, this particular assembly has three cylinders which nest into each other and a small piston. Appropriate seals must be fitted to each section and extension limits (strings) must be used to limit the excursion of each section during the fill stroke. This achieves some advantage in that with low back pressure, such as in a startup condition or in a depleted pressure situation in a product container, the entire array will be flattened to a significant height, thus compressing a large volume of air per stroke. As the back pressure quickly builds up, the down stroke force will no longer be adequate to compress the air in the largest cylinder. In effect, the large section decouples and stays dormant. The upper sections keep pumping until back pressure decouples the next section and so forth until finally, even the top solid piston "locks up" against back pressure.

The bellows analog to this approach, a tapered bellows, does not have these shortcomings. For the bellows, however, there are other design considerations which must be addressed. At high pressure, a bellows tends to billow out at the root radii instead of fold down. This tendency is more pronounced as the diameter increases. This is a problem associated with a tapered bellows, since the large convolutions are at peak pressure imposed by the smaller convolutions. One way to control this is by judicious attention to careful materials specification. This is an option strictly for injection molding. Another method is to fit external rings at the root of each of the larger convolutions. A preferred process is to take a completed bellows of any manufacture and to apply reinforcing fibers in the circumferential direction by first dipping the bellows in appropriate adhesive and then rolling on the fiber reinforcement. This thickening of selected portions of the bellows surface supplies just the right kind of anisotropic reinforcement, to resist radial expansion, while not adversely affecting the longitudinal suppleness of folding capability. In this manner, even inexpensive did molded bellows of thin uniform cross section can be made usable for this application.

To preserve some volume per reduced stroke at the higher pressures, in a further embodiment, the narrow section of the bellows is extended a few convolutions. Unfortunately, this produces an instability in the geometry with a tendency for the bellows to bend instead of fold neatly upon compression. This problem is be solved in two complementary ways. First, the top section is made a bit wider than the design point would suggest, with shallower convolutions and a larger root diameter. This in itself reduces the tendency to bend, but it may not produce the desired high pressure. The latter capability can be restored, while at the same time insuring straight folding without bending, by fitting the top section of the tapered bellows with a short guide rod internally that takes up most of the root diameter of the extended section of small convolutions. The effective volume of this top section is reduced by the rod volume, thereby insuring high pressure results.

When either the telescoping cylinders or the tapered bellows is utilized as the pumping means, special attention is given to the design of the inlet check valve. In either a simple piston and cylinder or a straight bellows, the vacuum generated during extension is substantial and uniform during the entire intake stroke. Small resistance from the inlet check valve is easily overcome and the internal volume is quite well filled for the pressure stroke. In contrast in the variations discussed above, at higher pressures the internal volume is almost full of air at atmospheric pressures or above until the very last bit of the intake stroke. At this point a very small vacuum is formed by virtue of the slightly increased internal volume as can be predicted by gas laws. This small vacuum will not pull in more air through the normal spring loaded ball check or duckbill type valve. This makes the high pressure section of a tapered bellows ineffective, since the required small increase of air in the internal volume never enters during the "intake" stroke. A virtually zero resistance inlet check valve is required for this application. Flap valves can approach this capability but they tend to be leaky in very small sizes. The solution is a weight operated inlet check valve. The inlet stroke coincides with the container being pulled down relative to the compressor driving weight; this results in the bellows extending. Therefore the valve has a weight attached to it, such that it would open during the same motion of the bellows extending. If the opening itself is sufficiently large as to be minimally restrictive, this would result in the capability of even a slight vacuum pulling in more air. Additionally, the weight that opened the valve on the downstroke helps to seal the valve on the upstroke compression stroke. Many design configurations exist for this type of valve. They include ball type valves with ball attached weights, weighted flapper valves and any type of weighted moving seal valve.

OBJECTS OF THE INVENTION

It is an object of the invention to improve over air propellant aerosol dispensers.

It is a further object of the present invention to provide a refillable dispenser wherein the compressor assembly is attached to a screw type cap, thereby permitting the pumping compressor to be vented through the cap, yet be isolated from the pressurized container.

It is a further object to provide a bellows pump means wherein the root radii efficiently fold without billowing out.

It is a further object to provide an air propellant continuous spray dispenser with a virtually zero resistance check valve.

The novel features which are considered characteristic for the invention are set forth in particular in tile appended Claims. The invention, itself, however, both as to its construction and its method of operation, together with additional objects and advantages thereof, will best be understood from the following description of its specific embodiments, when read in connection with the accompanying drawings.

DESCRIPTION OF THE DRAWINGS

FIGS. 3, 3A, 3B, 3C, 3D, 3E,3F and 3G show details of the tapered bellows portion of the pumping module of the invention.

DETAILED DESCRIPTION OF THE PREFERRED EMBODIMENT

Figure 2:
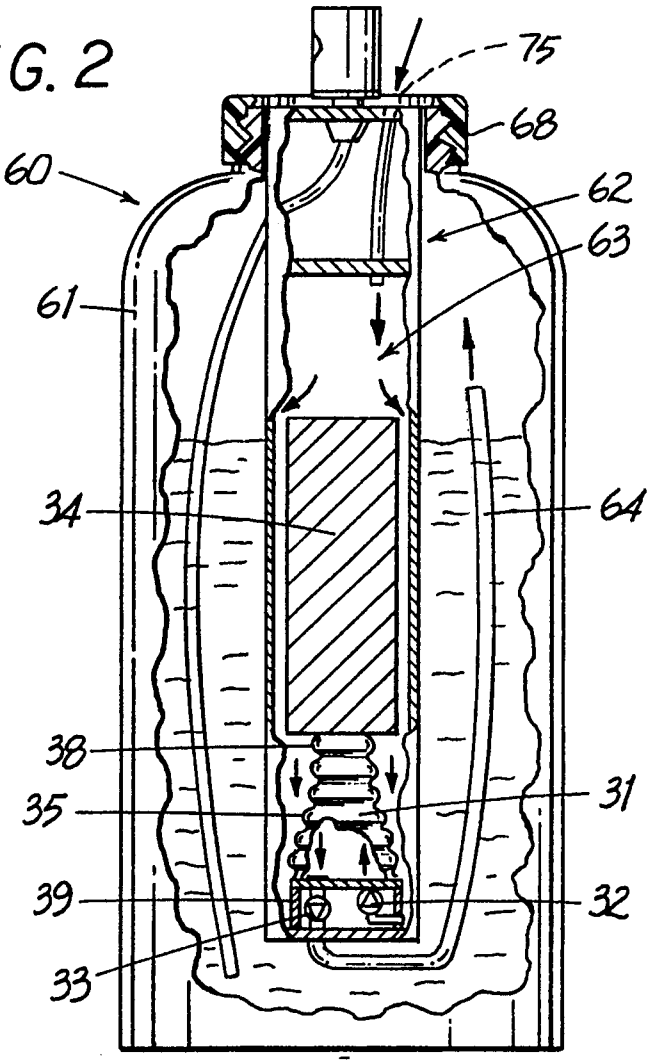
FIG. 2 is a side elevational view of the device as shown in FIG. 1, wherein the pump module includes a tapered bellows air compressor.
Figure 1:
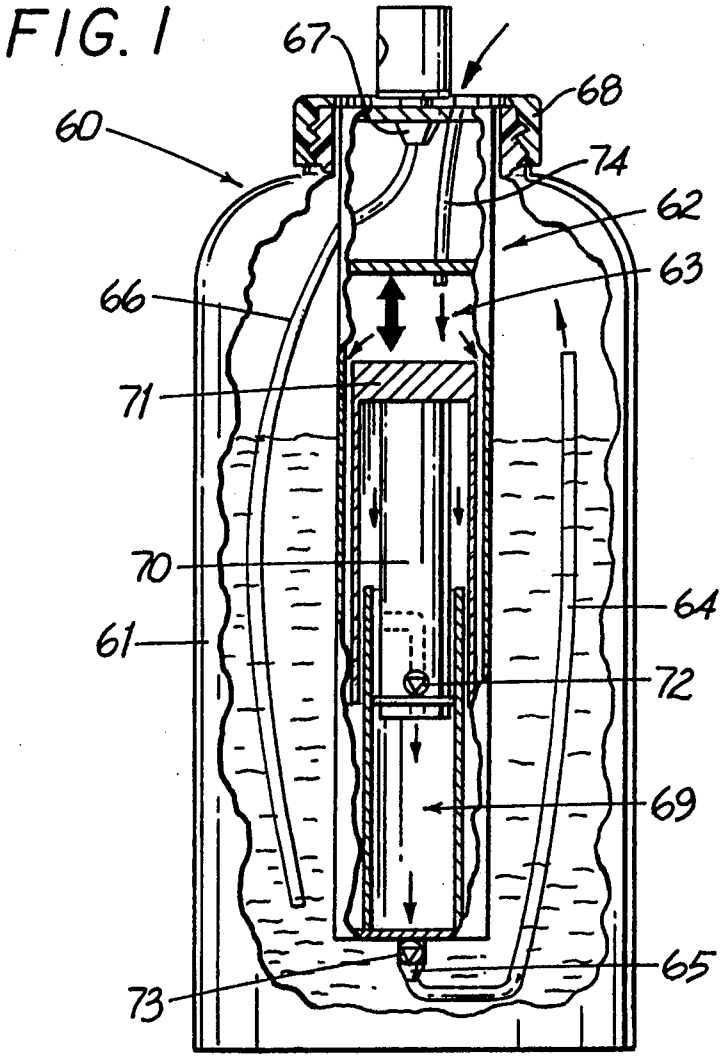
FIG. 1 is a side elevational view of the invention wherein the pump module is contained within the liquid module, and further wherein the pump module includes a piston and cylinder compressor means.

As shown in FIGS. 1 and 2, a preferred embodiment 60 includes a liquid module with liquid to be sprayed, a pump module 62 enclosing pump mechanism means 63 capable of supplying compressed air, a first conduit air discharge tube 64 disposed to a coupling extension 65 providing a connection between pump module 62 and liquid module 61, a second conduit 66 and an outlet valve 67, such that the second conduit 66 conducts liquid to be sprayed flowing in response to urging by compressed air from pump module 62.

The liquid module 61 contains the pump module 62 within the confines of the liquid module 61, wherein the liquid module 61 comprises a refillable dispenser provided with a threaded sealing cap 68.

The threaded sealing cap 68 is attached to the pump module 62.

The pump module 62 is insertable and removable with respect to the liquid module 61 when the sealing cap 68 is respectively applied to and removed from the liquid module 61, thus permitting use of a variety of liquid module shapes and sizes as may be commercially available.

As shown in FIG. 1, the pump module 62 contains a pumping means such as a weight activated pump 63 with a cylinder 69 and piston 70 arrangement for compressing air, the piston 70 being capable of a compression strokes, wherein the sequential inertial impulses provided by the weight 71 drive the piston 70 in its compression strokes.

The pumping means further is provided with two check valves 72 and 73, and a conduit 74 for intake air to be compressed, the conduit 74 being open to the outside air through a sealed aperture 75 traversing the threaded sealing cap 68.

As shown in FIGS. 2 and 3, the pump module 62 may alternately contain a weight activated tapered bellows pumping means 31, as in FIG. 2, and two check valves 32 and 33 for preventing backflow of compressed air, with the tapered bellows 31 being capable of compression strokes, wherein the sequential inertial impulses provided by the weight 34 drive the tapered bellows 31 in its compression strokes.

The tapered bellows 31 comprises a plurality of contiguous adjacent folded surfaces 35, each contiguous adjacent folded surface 35 being pliably capable of extensive and compressive motion relative to adjacent folded surfaces 35.

As shown in FIG. 3, the plurality of contiguous adjacent folded surfaces 35 form a pliable sealed air container 31 having an interior 48, an exterior 47, a first end 38 and a second end 39, wherein one folded surface 35 comprises the first end 38 and another folded surface 35 comprises the second end 39 of the tapered bellows 31. The tapered bellows 31 further has an exit 33 for compressed air 40 and an inlet 41 for ambient air to be compressed, further having an axial guidance pin 42 for aligning the folding of tapered bellow surfaces 35 during compression, wherein the tapered bellows contiguous adjacent folded surfaces 35 have a thickness 43, a central portion 44 and edges 45 and 46, each tapered bellows contiguous folded surface 35 being joined with adjacent folded surfaces 35 at the edges 45 and 46.

The tapered bellow 31 contiguous adjacent folded surfaces 35 have an exterior 47 and an interior 48, the thickness 43 being disposed therebetween, the exterior 47 of the surfaces 35 constituting the exterior of the sealed air container 31 and the interior 48 of the surfaces 35 constituting the interior of the sealed air container 31.

The tapered bellows 31 contiguous adjacent folded exterior surfaces 35 may alternately be provided with reinforcing fibers 49, the reinforcing fibers 49 being circumferentially and adhereingly wrapped about and attached to the exterior surfaces 35, the reinforcing fibers 49 for providing dimensional and directional guidance to the tapered bellows 31 during compression.

The pump means 62 has an inlet check valve 32 and an outlet check valve 33, the inlet check valve 32 having an open position, a closed position, a flap 50 capable of moving between the open and the closed position, and a weight 51 disposed upon the flap 50 for holding the flap 50 in the closed position, the weight 51 and flap 50 being movable from the closed to the open position in response to mechanical agitation of the pump module, and from the open to the closed position in response to gravity and the mechanical agitation of the pump module 62.

Figure 3C:
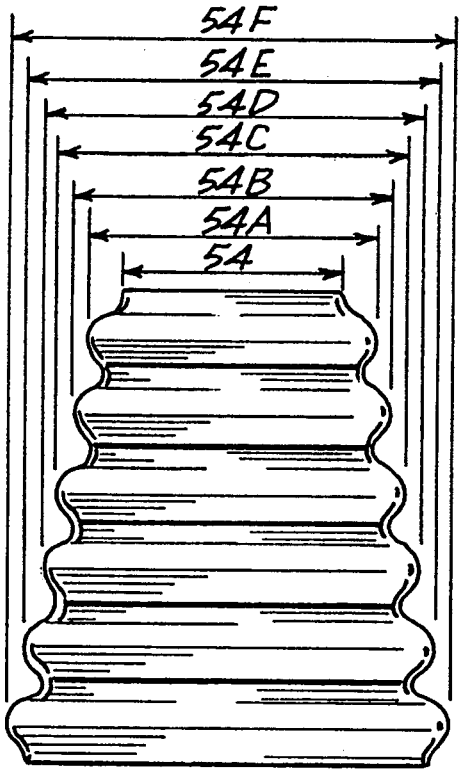
Figure 3D:
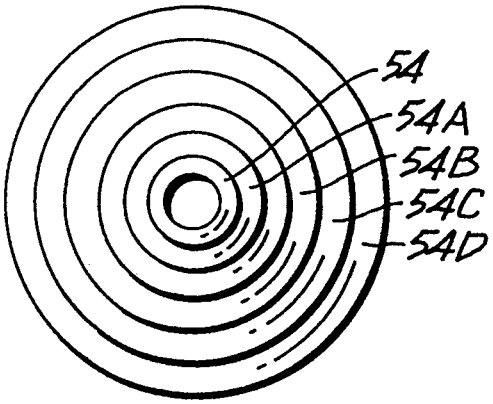
Figure 3F:
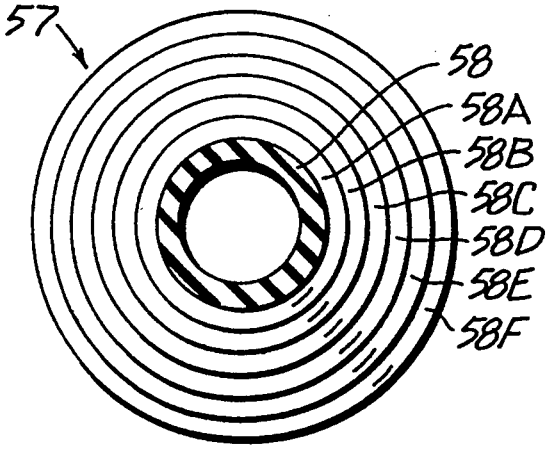
Figure 3E:
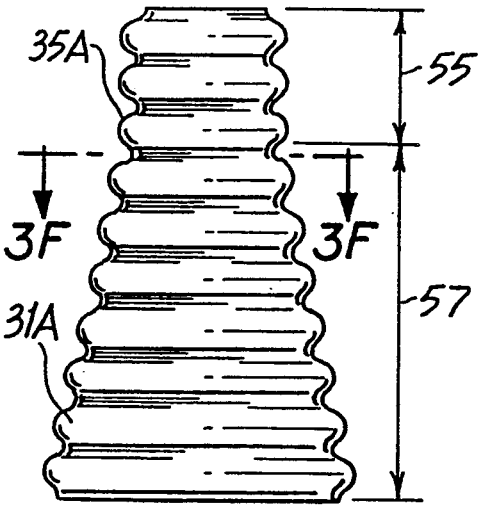
Figure 3G:
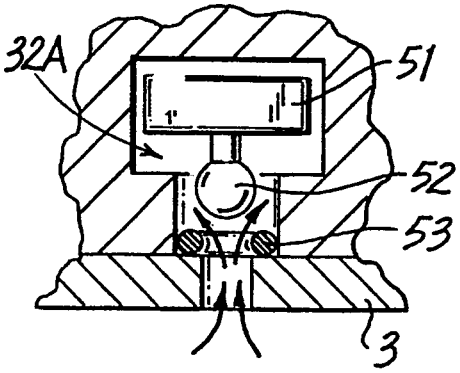

Alternatively, as shown in FIG. 3G, the tapered bellows may have an inlet check valve 32A, the inlet check valve 32A having an open position, a closed position, a weight 51 and a ball 52 and O-ring 53 sealing means capable of moving between the open and closed position. The weight 51 for holding the O-ring 53 sealing means is movable from the closed to the open position in response to mechanical agitation of the pump module 3 and movable from the open to the closed position in response to gravity and the mechanical agitation of the pump module 3.

Figure 4:
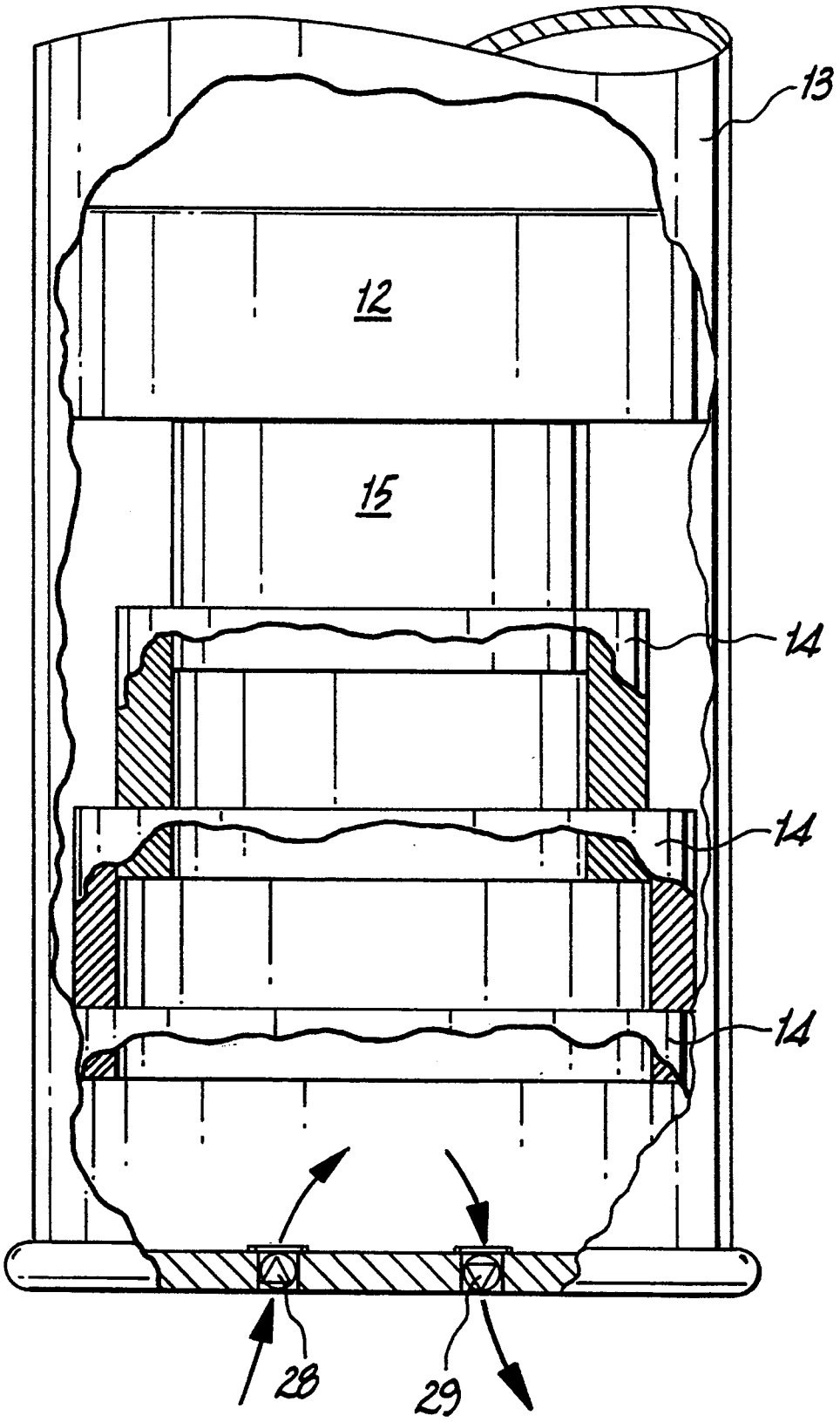
FIG. 4 is a side elevational view of a telescoping piston and cylinder portion of the pumping module of the invention.

As shown in FIG. 4, an alternative piston and cylinder pumping module includes a housing 13, a driving weight 12, inlet and outlet check valves 28 and 29, and a small piston 15 driving three cylinders 14, which cylinders 14 nest into each other.

Figure 5:
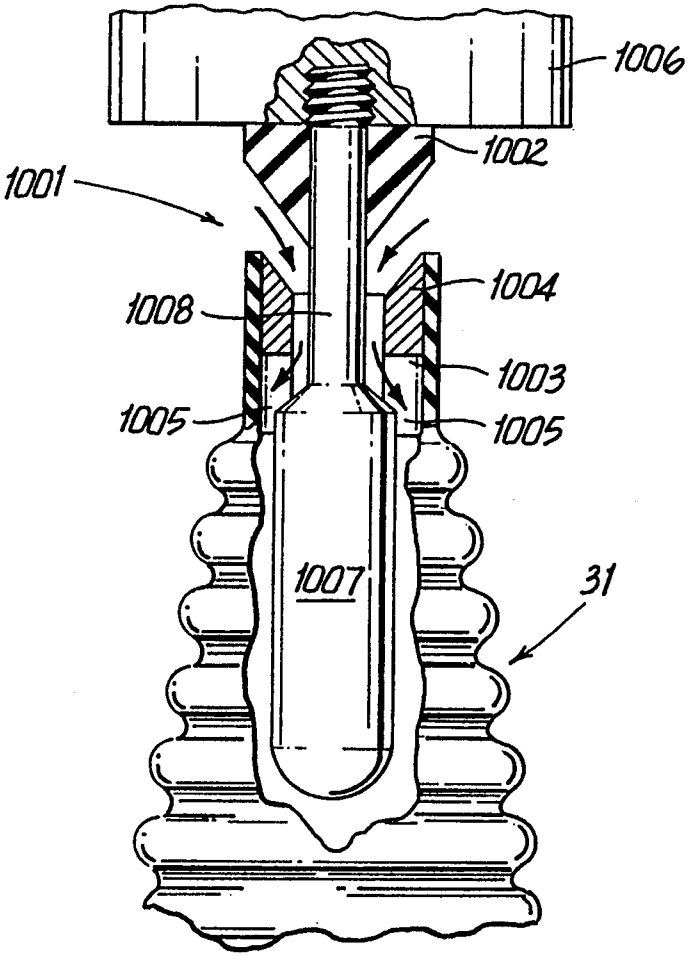
FIG. 5 is a side elevational view of a preferred embodiment for an inlet check valve for a tapered bellows embodiment of the pumping module.

Alternatively, as shown in FIG. 5, the tapered bellows pump may have a weight-operated bellows inlet check valve 1001, including a driving weight 1006, a relatively narrow, elongated connecting shaft 1008, and a guidance pin 1007, the connecting shaft 1008 being disposed between and connecting driving weight 1006 and guidance pin 1007, such that the driving weight 1006, connecting shaft 1008 and guidance pin 1007 constitute an integral compression unit capable of vertical sealing and unsealing motion, the driving weight 1006 being disposed in a top position, the connecting shaft 1008 being disposed in a medial position, and the guidance pin 1007 being disposed in a bottom position within and relative to the integral compression unit.

The pump means further has a soft seal 1002, preferably rubber, mounted upon connecting shaft 1008 by means of a vertical bore through soft rubber seal 1002, the vertical bore sealably accepting insertion of the connecting shaft 1008 therethrough; the soft rubber seal being in an unmovable relationship to connecting shaft 1008. The pump means also has a hollow cylindrical bellows mounting collar 1003, the mounting collar 1003 further having a top and a bottom, the top further including a beveled valve seat 1004 and the bottom having beveled notches 1005, such that the soft rubber seal 1002 is inertially urged into sealable contact with beveled valve seat 1004 by driving weight 1006 during the bellows compression stroke.

The vertical sealing motion of the integral compression unit provides the compression stroke, the vertical sealing motion of the compression unit being relative to mounting collar 1003, the vertical unsealing motion of the compression unit comprising upward motion of the compression unit relative to mounting collar 1003.

The weight operated bellows inlet check valve permits ambient air to enter the bellows in response to the unsealing motion of the compression unit and the weight operated bellows compresses air within the bellows in response to the sealing motion of the compression unit. The pump means of FIG. 5 can be incorporated as a substitute for pump means 31 shown in FIG. 2. The driving weight 34 in FIG. 2 acts as an attachment point for guidance pin 1007 of FIG. 5.

As shown in FIGS. 3, 3C and 3D tapered bellows portion of the pumping module may have a plurality of contiguous adjacent folded surfaces 35 constituting a tapered continuum of dimensional variation, wherein each such folded surface 35 has a cross sectional area 54, 54A, 54B, 54C, 54D, the folded surface 35 at the first end 38 having the smallest cross sectional area 54 and each successive folded surface therefrom having progressively larger cross sectional areas 54, 54A, 54B, 54C, 54D.

As shown in FIGS. 3E and 3F tapered bellows contiguous adjacent folded surfaces 35 may include a section 55 which is dimensionally uniform and a section 57 which is dimensionally tapered, wherein the section 55 which is dimensionally uniform and the section 57 which is dimensionally tapered comprise a single sealed tapered bellows air container 31A.

The section 55 which is dimensionally uniform has a uniform cross sectional area 58 smaller than the cross sectional area of the dimensionally tapered section 57.

The dimensionally tapered section 57 varies uniformly from a smallest cross sectional area 58A to a largest cross sectional area 58F, and the dimensionally tapered section 57 is contiguous with the dimensionally uniform section 55 such that the dimensionally tapered section 57 is smoothly joined to the dimensionally uniform section 55, with the smallest cross sectional 58A area of the dimensionally tapered section 57 being disposed nearest to the dimensionally uniform section 55.

The foregoing description is directed towards the construction shown in the specifications and drawings herein, but basic modifications may be made, without departing from the spirit and scope of the appended Claims.

I claim:

1. An improved apparatus for discharging liquids in a spray, wherein the improvement comprises:

a. a pump module containing a pumping means, said pumping means being capable of supplying compressed air;

b. a liquid module containing a liquid to be sprayed, wherein said liquid module contains said pump module within the confines of said liquid module;

c. a first conduit disposed within said liquid module and a coupling extension attached to said pump module, said coupling extension providing a connection between said pump module and said liquid module for the transfer of compressed air to said liquid module; and, d. a second conduit and an outlet valve, said second conduit conducting the liquid to be sprayed from said liquid module to said outlet valve for discharge, the liquid to be sprayed flowing in response to urging by said compressed air, wherein said liquid module comprises a refillable dispenser provided with a threaded sealing cap;

e. said threaded sealing cap being attached to said pump module;

f. said pump module being insertable and removable with respect to said liquid module when said sealing cap is respectively applied to and removed from said liquid module, thus permitting use of a variety of liquid module shapes and sizes as may be commercially available.

2. An improved apparatus for discharging liquids in a spray, wherein the improvement comprises:

a. a pump module containing pumping means, said pumping means being capable of supplying compressed air;

b. a liquid module containing a liquid to be sprayed, wherein said liquid module contains said pump module within the confines of said liquid module;

c. a first conduit disposed within said liquid module and a coupling extension attached to said pump module, said coupling extension attached to said pump module, said coupling extension providing a connection between said pump module and said liquid module for the transfer of compressed air to said liquid module;

d. a second conduit and an outlet valve, said second conduit conducting the liquid to be sprayed from said liquid module to said outlet valve for discharge, said liquid to be sprayed flowing in response to urging by said compressed air;

e. wherein said pump module contains a pumping means comprising a weight of a weight activated pump with a piston of a cylinder-and-piston arrangement for compressing air;

f. said piston being capable of compression strokes, wherein the sequential inertial impulses provided by said weight drive said piston in its compression strokes within a guide means;

g. said pumping means further being provided with two check valves and, h. a conduit for admitting air into said pump module to be compressed, said conduit being open to the outside air through a sealed aperture traversing a threaded sealing cap.

3. The apparatus as in claim 2, wherein said guide means for said driving weight comprises a plurality of telescoping cylinders of dimensional variation, which said cylinders nest into each other, and said piston being engagable with said driving weight.

4. An improved apparatus for discharging liquids in a spray, wherein the improvement comprises:

a. a pump module containing pumping means, said pumping means being capable of supplying compressed air;

b. a liquid module containing a liquid to be sprayed, wherein said liquid module contains said pump module within the confines of said liquid module;

c. a first conduit disposed within said liquid module and a coupling extension attached to said pump module, said coupling extension providing a connection between said pump module and said liquid module for the transfer of compressed air to said liquid module;

d. a second conduit and an outlet valve, said second conduit conducting the liquid to be sprayed from said liquid module to said outlet valve for discharge, said liquid to be sprayed flowing in response to urging by said compressed air;

e. wherein said pump module contains a weight activated pumping means including a tapered bellows with said tapered bellows being capable of compression strokes, wherein the sequential inertial impulses provided by a driving weight drive said tapered bellows in its compression strokes.

5. The apparatus of claim 4 wherein the tapered bellows comprises a plurality of contiguous adjacent folded surfaces, each contiguous adjacent folded surface being pliably capable of extensive and compressive motion relative to adjacent folded surfaces.

6. The apparatus of claim 5, the plurality of contiguous adjacent folded surfaces forming a pliable sealed air container having an interior, an exterior, a first end and a second end, wherein one folded surface comprises the first end and another folded surface comprises the second end of the tapered bellows, the tapered bellows further having an exit for compressed air and an inlet for ambient air to be compressed.

7. The apparatus of claim 6, further having an axial guidance pin for aligning the folding of tapered bellow surfaces during compression.

8. The apparatus of claim 6, wherein the tapered bellows contiguous adjacent folded surfaces have a thickness, a central portion and edges, each tapered bellows contiguous folded surface being joined with adjacent folded surfaces at the edges.

9. The apparatus of claim 8, wherein the tapered bellow contiguous adjacent folded surfaces have an exterior and an interior, the thickness being disposed therebetween, the exterior of the surfaces comprising the exterior of the sealed air container and the interior of the surfaces comprising the interior of the sealed air container.

10. The apparatus of claim 9, wherein the tapered bellows contiguous adjacent folded exterior surfaces are provided with reinforcing fibers, the reinforcing fibers being circumferentially and adhereingly wrapped about and attached to the exterior surfaces, the reinforcing fibers for providing dimensional and directional guidance to the tapered bellows during compression.

11. The apparatus of claim 6, such that the plurality of contiguous adjacent folded surfaces comprise a tapered continuum of dimensional variation, wherein each such folded surface has a cross sectional area, the folded surface comprising the first end having the smallest cross sectional area and each successive folded surface therefrom having progressively larger cross sectional areas.

12. The apparatus of claim 4, having an inlet check valve and an outlet check valve, the inlet check valve having an open position, a closed position, a flap capable of moving between the open and the closed position, and a weight disposed upon the flap for holding the flap in the closed position, the weight and flap being movable from the closed to the open position in response to mechanical agitation of the pump module, and from the open to the closed position in response to gravity and the mechanical agitation of the pump module.

13. The apparatus of claim 4, having an inlet check valve and an outlet check valve, the inlet check valve having an open position, a closed position, a weight, and a ball and O-ring sealing means capable of moving between the open and the closed position, the weight for holding the O-ring sealing means in the closed position, the weight and O-ring sealing means being movable from the closed to the open position in response to mechanical agitation of the pump module and movable from the open to the closed position in response to gravity and the mechanical agitation of the pump module.

* * * * *